US006015103A

United States Patent [19]

Kotkowicz

[11] Patent Number: 6,015,103

[45] Date of Patent: Jan. 18, 2000

[54] FILTER FOR FUEL INJECTOR

[75] Inventor: George A. Kotkowicz, Grand Rapids, Mich.

[73] Assignee: General Motors Corporation, Detroit, Mich.

[21] Appl. No.: 09/093,764

[22] Filed: Jun. 8, 1998

[51] Int. Cl.[7] ..... B05B 1/30; B05B 1/14; F02M 39/00

[52] U.S. Cl. ..... 239/585.4; 239/533.3; 239/533.11; 239/533.12; 239/585.1; 239/585.5; 239/590; 239/590.3; 239/DIG. 23; 251/129.21

[58] Field of Search ..... 239/533.2, 533.3, 239/533.9, 533.11, 533.12, 533.14, 585.1, 585.4, 585.5, 590, 590.3, 590.5, DIG. 23; 251/129.21

[56] References Cited

U.S. PATENT DOCUMENTS

| | | | |
|---|---|---|---|
| 5,236,173 | 8/1993 | Wakeman | 239/585.4 X |
| 5,423,489 | 6/1995 | Wood | 239/575 |
| 5,636,827 | 6/1997 | Kilgore et al. | 239/585.5 X |
| 5,678,767 | 10/1997 | Rahbar | 239/DIG. 23 X |
| 5,755,386 | 5/1998 | Lavan et al. | 239/585.4 |
| 5,775,600 | 7/1998 | Wildeson et al. | 239/585.4 |
| 5,860,601 | 1/1999 | Egizi | 239/533.12 |

*Primary Examiner*—Andres Kashnikow
*Assistant Examiner*—Robin O. Evans
*Attorney, Agent, or Firm*—Karl F. Barr; Vincent A. Cichosz

[57] ABSTRACT

A fuel injector for delivery of fuel to an internal combustion engine has an injector body defining a central axis, a fuel discharge opening coaxial with the central axis having a valve seat extending thereabout, and a valve element normally seated on the valve seat to close the fuel discharge opening. The valve element is operable to move off of the valve seat to open the fuel discharge opening allowing fuel to pass through. A filter-valve guide is coaxially positioned upstream of the valve seat and includes an annular closed bottom, an outer wall extending coaxially upwardly from the annular closed bottom to define an outer diameter, and an inner wall extending coaxially upwardly from the annular closed bottom to define a central opening. The valve element passes through the central opening and the guide inner wall guides the valve element as it moves relative to the valve seat. The annular closed bottom includes filtration openings to filter particulates from fuel passing therethrough, such that particulates are prevented from flowing to the valve seat.

3 Claims, 2 Drawing Sheets

FILTER FOR FUEL INJECTOR

TECHNICAL FIELD

This invention relates to a filter for fuel injectors used for delivery of fuel to internal combustion engines.

BACKGROUND OF THE INVENTION

In fuel injectors for internal combustion engines, it is important to minimize contaminants introduced to the fuel injector. Contaminants may interfere with the fuel injector valve operation if they adhere to the valve seat and prevent the valve from completely seating. One source of contaminants may be the entering fuel which may be filtered with an external filter upstream of the fuel injector inlet. Contaminants may also originate within the fuel injector during the manufacturing process and such contamination is not affected by an external upstream filter. One means known to reduce these manufacturing contaminants is with an internal filter located upstream of the valve, supported by an adjacent, downstream valve guide. This filtration system adds a separate part to the fuel injector assembly.

SUMMARY OF THE INVENTION

The present invention is directed to a fuel injector, for use in an internal combustion engine, having a valve guide with an integral filter. The filter-valve guide is operable to guide the valve assembly, while the integral filtration openings serve to prevent particulates from reaching the valve to valve seat interface. The filtration function is included without supplemental components being added to the fuel injector assembly.

DESCRIPTION OF THE PREFERRED EMBODIMENT

Figure 1:
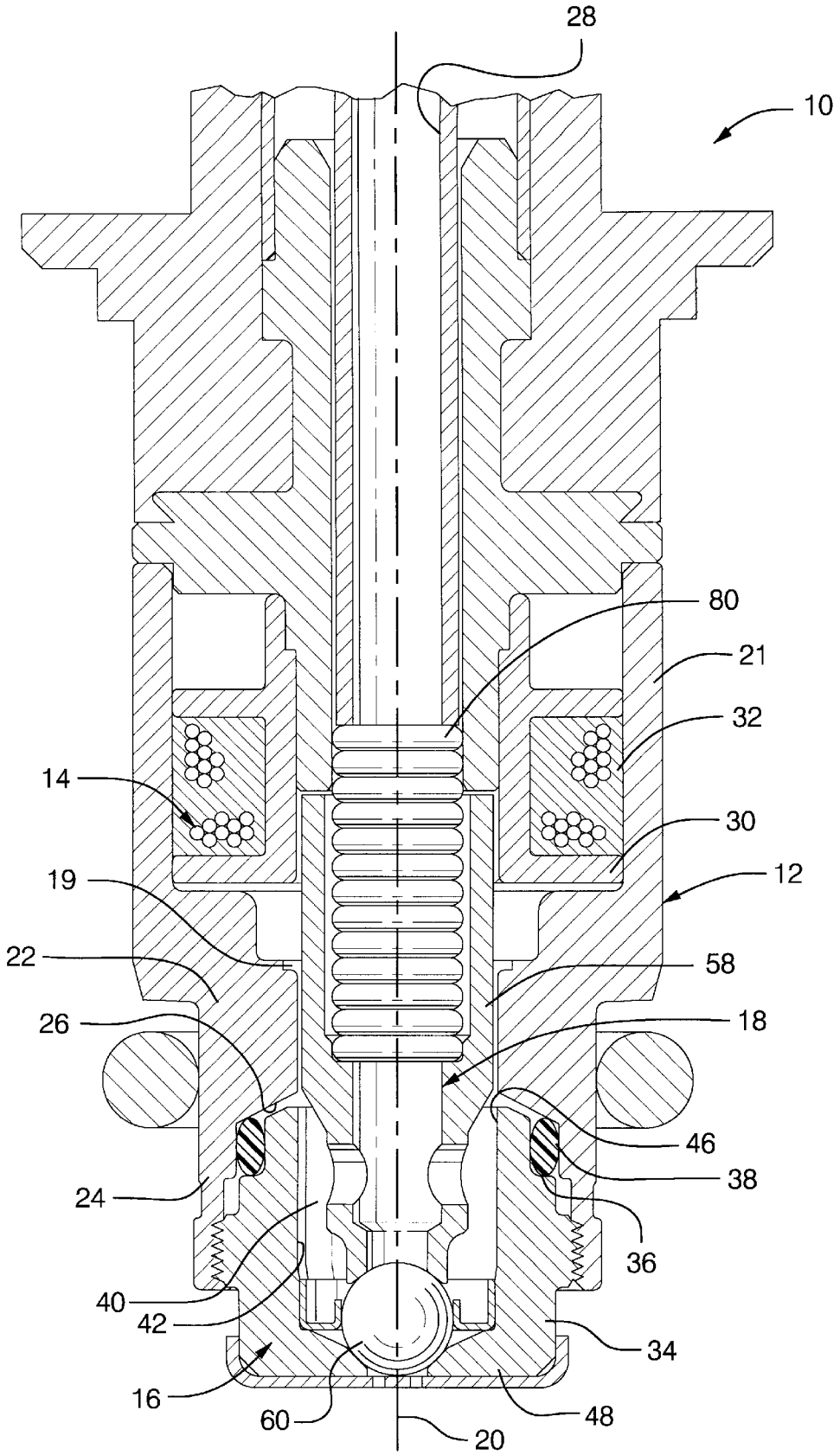
FIG. 1 is a partial side view, in section, of a fuel injector embodying features of the present invention.
Figure 2:
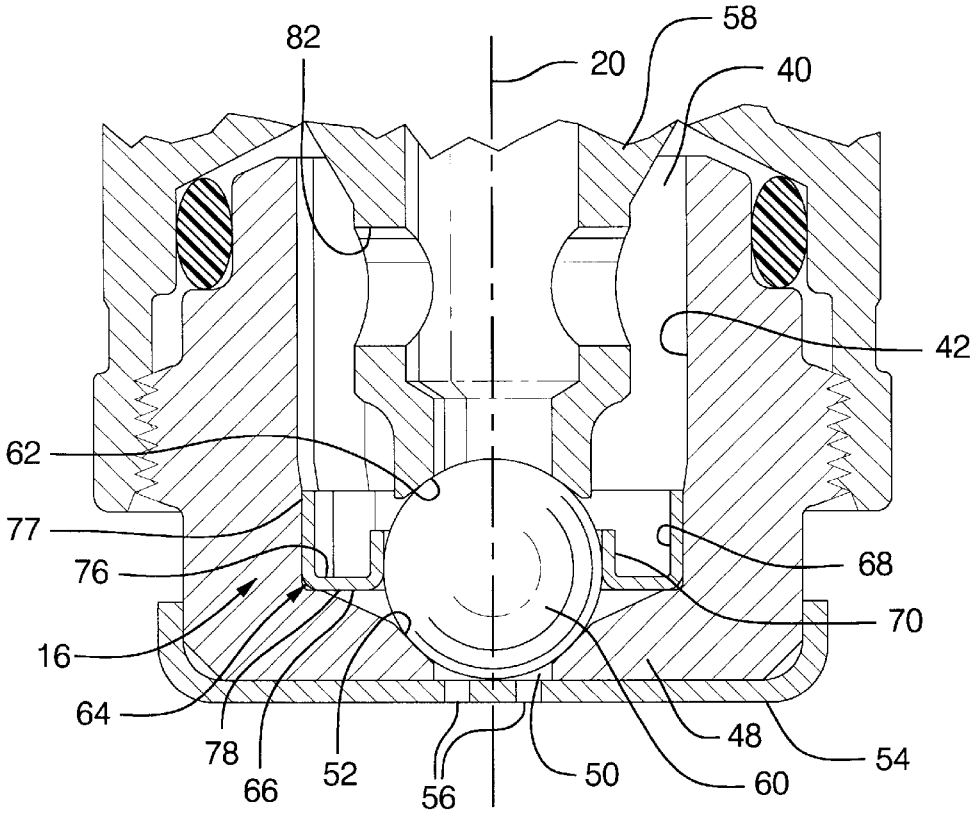
FIG. 2 is an enlarged side view of a portion of FIG. 1.

FIGS. 1 and 2 illustrate an electromagnetic fuel injector, designated generally as 10, which includes as major components thereof, an injector body 12, a solenoid actuator assembly 14, a nozzle assembly 16, and a valve assembly 18.

The injector body 12 is a generally cylindrical, hollow tubular member defining a central tubular space 19 and a central axis 20. The body 12 includes an upper solenoid case portion 21, a narrow armature case portion 22, and a lower nozzle case portion 24. A lower shoulder 26 of the injector body 12 extends between the narrow armature case portion 22 and the lower nozzle case portion 24. A fuel tube 28 at the upper end of the injector body 12 delivers pressurized fuel from a fuel source, not shown.

The solenoid actuator assembly 14 is disposed within the upper solenoid case portion 21 and includes a spool-like, tubular bobbin 30 supporting a wound wire solenoid coil 32. Energizing the solenoid coil 32 actuates the valve assembly 18.

The nozzle assembly 16 is disposed within the lower nozzle case portion 24. It includes a nozzle body 34 having a cup-shaped configuration with a stepped upper shoulder 36 for receiving a sealing member such as an O-ring 38. The sealing member 38 is disposed between the stepped upper shoulder 36 of the nozzle body 34 and the lower nozzle case portion 24 of the injector body 12, thereby establishing a seal against fuel leakage at the interface of the nozzle assembly 16 and the injector body 12.

An internal cylindrical cavity 40 in the nozzle body 34 is defined by a cylindrical wall 42 which extends from an open, upper end 46 of the nozzle body 34 to terminate in a closed, lower end 48 of the nozzle body. The cylindrical cavity 40 operates as a fuel supply repository within the nozzle assembly 16. The closed, lower end 48 of the nozzle body 34 has a fuel discharge opening 50 therethrough, coaxial with the central axis 20 of the injector body 12, and having an annular, frustoconical valve seat 52 disposed thereabout.

At the lower end 48 of the nozzle body 34, downstream of the fuel discharge opening 50, is placed a fuel spray director plate 54. The director plate 54 includes fuel directing openings 56 extending therethrough. Fuel passing through the fuel discharge opening 50 is distributed across the director plate 54 to the fuel directing openings 56. The fuel directing openings 56 are oriented to generate a desired spray configuration in the fuel discharged from injector 10.

The valve assembly 18 includes a tubular armature 58 extending axially within the central tubular space 19 of the injector body 12 and a valve element 60 located within the nozzle body 34. The valve element 60 may be a spherical ball, which is welded to the lower annular end 62 of the tubular armature 58. The radius of the valve element 60 is chosen for seating engagement with the valve seat 52. The tubular armature 58 is formed with a predetermined outside diameter so as to be loosely slidable within the inside diameter of the narrow armature case portion 22 of the injector body 12.

Figure 3:
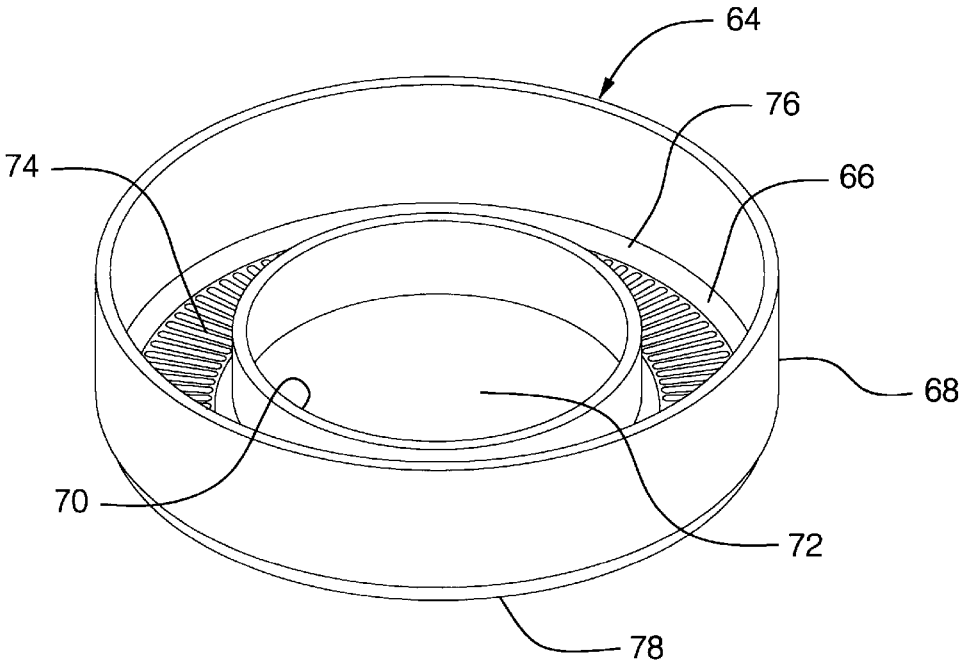
FIG. 3 is an enlarged isometric view of the filter-valve guide of the present invention.

Coaxially positioned within the cylindrical cavity 40 of the nozzle body 34, adjacent the valve seat 52 is a filter-valve guide 64, FIGS. 2 and 3. The filter-valve guide 64 is configured as an annular cup with an annular closed bottom 66. Extending coaxially upwardly from the closed bottom 66 are a cylindrical outer wall 68 and a cylindrical inner wall 70. The outer wall 68 defines the outer diameter of the filter-valve guide 64, while the inner wall 70 defines a central, valve-guiding opening 72. The annular closed bottom 66 has a plurality of filtration openings 74 extending from the upstream side 76 to the downstream side 78. The filtration openings 74 shown in the figure are narrow slots but may have other configurations such as round.

The filter-valve guide 64 may be constructed of a material such as 300 or 400 series stainless steel. Material selection is based on the mechanical properties of the material, corrosion resistance, wear resistance, and manufacturing considerations. Plastic may be considered as an alternate material if it satisfies the requirements for dimensional stability, chemical resistance, wear resistance, and manufacturability. The filtration openings 74 may be constructed by overlaying a film with the openings defined, over the annular closed bottom 66 and photochemically etching the stainless steel. The etching process may be performed before or after a forming operation to produce the outer and inner walls 68,70 of the annular cup shaped filter-valve guide 64.

The filter-valve guide 64 is installed coaxially with the injector body central axis 20 with the outer wall 68 of the filter-valve guide establishing an interference fit with the cylindrical wall 42 of the nozzle body 34. The interference fit establishes a seal 77 to minimize fuel leakage around the filter-valve guide. The central opening 72 is for passage of the valve element 60 wherein the filter-valve guide inner wall 70 closely encircles the valve element to minimize fuel leakage between the guide inner wall and the valve element and operates to axially guide the valve element as it moves reciprocally into and out of engagement with the valve seat 52. The fitted installation of the filter-valve guide 64 prevents fuel from bypassing filtration.

As a result of the installation of the filter-valve guide 64 described, fuel flowing from the cylindrical cavity 40 to the fuel discharge opening 50 flows through the filtration openings 74 of the filter-valve guide where particulates are removed prior to reaching the valve seat 52. It may be desirable to size the width of the filtration openings 74 to capture particulates larger than the tolerance between the valve element 60 and the valve seat 52 when the valve is open. The smallest dimension may range approximately from 0.04 to 0.10 mm depending on the particular application.

The valve element 60 of the valve assembly 18 is normally biased into closed, seated engagement with the valve seat 52 by a biasing member such as a valve return spring 80. Upon energizing the solenoid assembly 14, the tubular armature 58 and associated valve element 60 are drawn axially, off of the valve seat 52 against the bias of the return spring 80. Pressurized fuel enters the injector 10 from the fuel source, not shown, and passes through the fuel tube 28, to enter the cylindrical cavity 40 in the nozzle body 34 through circumferentially spaced openings 82 in the tubular armature 58.

As previously described, the fuel passes through the filtration openings 74 in the filter-valve guide 64 and exits through the fuel discharge opening 50 in the valve seat 52. Fuel exiting the fuel discharge opening 50 is distributed across the fuel director plate 54 to the fuel directing openings 56, for discharge from the fuel injector 10. Deenergizing the solenoid assembly 14 releases the tubular armature 58, which returns the valve element 60 to the normally closed position against the valve seat 52 under the bias of the return spring 80, and stops the flow of fuel therethrough.

The foregoing description of the preferred embodiment of the invention has been presented for the purpose of illustration and description. It is not intended to be exhaustive, nor is it intended to limit the invention to the precise form disclosed. It will be apparent to those skilled in the art that the disclosed embodiment may be modified in light of the above teachings. The embodiment was chosen to provide an illustration of the principles of the invention and its practical application to thereby enable one of ordinary skill in the art to utilize the invention in various embodiments and with various modifications as are suited to the particular use contemplated. Therefore, the foregoing description is to be considered exemplary, rather than limiting, and the true scope of the invention is that described in the following claims.

I claim:

1. A fuel injector for delivery of fuel to an internal combustion engine comprising an injector body defining a central axis, a fuel discharge opening coaxial with said central axis having a valve seat extending thereabout, a valve element normally seated on said valve seat to close said fuel discharge opening and operable to move off of said valve seat to open said fuel discharge opening allowing fuel to pass therethrough, a filter-valve guide positioned coaxially with said central axis, upstream of said valve seat, comprising an annular closed bottom, an outer wall extending coaxially upwardly from said annular closed bottom, and an inner wall extending coaxially upwardly from said annular closed bottom defining a central opening for passage of said valve element wherein said inner wall guides said valve element as said valve element moves relative to said valve seat, and said annular closed bottom comprising filtration openings to filter particulates from fuel passing therethrough, wherein particulates are prevented from flowing to said valve seat.

2. A fuel injector for delivery of fuel to an internal combustion engine, as in claim 1, said filtration openings having minimum dimension ranging from 0.04 to 0.10 millimeters.

3. A fuel injector for delivery of fuel to an internal combustion engine comprising an injector body defining a central axis, a cup-shaped nozzle body disposed within said injector body having an open upper end, a closed lower end, and a cylindrical wall extending therebetween, said closed lower end having a fuel discharge opening coaxial with said central axis having a valve seat extending thereabout, a valve element normally seated on said valve seat to close said fuel discharge opening and operable to move off of said valve seat to open said fuel discharge opening allowing fuel to pass therethrough, an annular cup-shaped filter-valve guide positioned coaxially with said central axis, upstream of said valve seat, comprising an annular closed bottom, an outer wall extending coaxially upwardly from said annular closed bottom establishing a seal with said cylindrical wall to minimize fuel flow between said filter-valve guide and said nozzle body, and an inner wall extending coaxially upwardly from said annular closed bottom defining a central opening for passage of said valve element wherein said inner wall closely encircles said valve element to minimize fuel flow between said filter-valve guide and said valve element and to guide said valve element as said valve element moves relative to said valve seat, and said annular closed bottom comprising filtration openings to filter particulates from fuel passing therethrough, wherein particulates are prevented from flowing to said valve seat.

* * * * *